United States Patent [19]

Otto et al.

[11] Patent Number: 4,741,142

[45] Date of Patent: May 3, 1988

[54] SLIM SEAM ROOFING PANEL

[75] Inventors: Lyle G. Otto, Terrell; Justin L. McNamee, Dallas, both of Tex.

[73] Assignee: Alumax Inc., San Mateo, Calif.

[21] Appl. No.: 898,371

[22] Filed: Aug. 20, 1986

[51] Int. Cl.[4] ..... E04D 1/34

[52] U.S. Cl. ..... 52/520; 52/529; 52/545; 52/547

[58] Field of Search ..... 52/478, 506, 509, 520, 52/521, 528, 545, 547, 549, 538, 588, 760, 529

[56] References Cited

U.S. PATENT DOCUMENTS

| | | | |
|---|---|---|---|
| 188,079 | 3/1877 | Smith . | |
| 425,830 | 4/1890 | Sagendorph . | |
| 1,198,764 | 9/1916 | Pruden . | |
| 2,178,415 | 10/1939 | Ansel | 52/545 X |
| 2,399,891 | 5/1946 | Routt . | |
| 2,847,099 | 8/1958 | Gruber . | |
| 3,127,962 | 4/1964 | James . | |
| 3,131,794 | 5/1964 | Bender . | |
| 3,209,503 | 10/1965 | Mostoller | 52/547 X |
| 3,226,901 | 1/1966 | Harter | 52/545 X |
| 3,253,376 | 5/1966 | Straus | 52/520 X |
| 3,303,619 | 2/1967 | Janecek . | |
| 3,323,269 | 6/1967 | Widdowson . | |
| 3,388,518 | 6/1968 | Scott | 52/547 X |
| 3,394,524 | 7/1968 | Howarth . | |
| 3,402,526 | 9/1968 | Baxter . | |
| 3,469,873 | 9/1969 | Glaros . | |
| 3,481,094 | 12/1969 | Taylor . | |
| 3,511,011 | 5/1970 | Straus | 52/545 X |
| 3,606,718 | 9/1971 | Curran . | |
| 3,733,767 | 5/1973 | Craik . | |
| 3,998,019 | 12/1976 | Reinwall, Jr. | 52/478 |
| 4,102,105 | 7/1978 | Taylor et al. . | |
| 4,217,741 | 8/1980 | Cole . | |
| 4,266,385 | 5/1981 | Oehlert . | |
| 4,269,012 | 5/1981 | Mattingly et al. . | |
| 4,435,937 | 3/1984 | Stone . | |
| 4,497,151 | 2/1985 | Simpson et al. . | |
| 4,522,005 | 6/1985 | Seaburg et al. . | |
| 4,561,233 | 12/1985 | Harter et al. . | |
| 4,570,404 | 2/1986 | Knudson . | |

FOREIGN PATENT DOCUMENTS

| | | | |
|---|---|---|---|
| 42883 | 3/1970 | Australia | 52/520 |

*Primary Examiner*—Alfred C. Perham
*Assistant Examiner*—Richard E. Chilcot, Jr.
*Attorney, Agent, or Firm*—Limbach, Limbach & Sutton

[57] ABSTRACT

A slim seam roofing panel comprises a generally planar roofing panel section, a first, upstanding male section integrally connected to the panel section, and a second, upstanding female section integrally connected to the panel section at a location remote from and parallel with the male section for mounting over the male section of an identical adjoining roofing panel so as to form a slim seam. The male section includes a vertical portion that is received within the female section, a lower arcuate mounting portion and parallel upper and lower horizontal extension portions. The female section includes two parallel vertical spaced-apart portions that receive the male section vertical portion, and a horizontal extension portion that is received within the male section horizontal extension portions. The roofing panel also comprises an anchoring member that captures the male section arcuate mounting portion.

14 Claims, 1 Drawing Sheet

SLIM SEAM ROOFING PANEL

DESCRIPTION

TECHNICAL FIELD

This invention relates to roofing panels and, more particularly, to a slim seam roofing panel.

BACKGROUND ART

Roofing panels are common in the art. Such prior art roofing panels include those disclosed in Simpson et al., U.S. Pat. No. 4,497,151; Widdowson, U.S. Pat. No. 3,323,269; Routt, U.S. Pat. No. 2,399,891; Sagendorph, U.S. Pat. No. 425,830; and Smith, U.S. Pat. No. 188,079.

An ideal roofing panel should have the following attributes. First, it should be aesthetically pleasing to the viewer. Where, as here, roofing panels having standing seams are desired for duplicating the "antiqued look," such standing seams should have aesthetically pleasing, slim profiles. The thickness of the standing seams should be minimized. Seam is defined as that portion of the roof where two roofing panels are mated or joined. Generally, the seam is a vertical extension that is orthogonal to the plane of the roofing panel. Next, the ideal roofing panel should be designed such that a user could assemble these roofing panels with ease. Cumbersome mechanical seaming devices or tools should not be required. In addition, the ideal roofing panel should be capable of minimizing wind uplift. Moreover, the ideal roofing panel should be permitted to thermally expand or contract. Further, mounting members for anchoring the roofing panel to a roof structure should be concealed, further enhancing the aesthetic appearance.

In light of such attributes, each of the abovementioned patents fails to include one or more of the attributes. For example, Routt fails to minimize the thickness of his interlocking seam. The thickness of his vertical extension is greater than three times the thickness of the roofing panel since the vertical extension includes the thickness of an anchoring plate. Similarly, the thickness of the seam of the roofing panel illustrated in Sagendorph also includes the thickness of an anchor In both Simpson and Smith, the thickness of each of their seams is approximately five times the thickness of the roofing panel. In addition, a mechanical seaming device must be used to form the seam in Smith. As for Widdowson, his standing seam must also be die-clinched or punched by a mechanical device.

DISCLOSURE OF THE INVENTION

It is a major object of the present invention to provide a roofing panel that is aesthetically pleasing and, in particular, a roofing panel the vertical seam of which has a minimal thickness.

It is another object of the present invention to provide a roofing panel that is easy to assemble and, in particular, a roofing panel that does not require additional mechanical tools during assembly.

It is a further object of the present invention to provide a roofing panel that is capable of minimizing wind uplift.

It is another object of the present invention to provide a roofing panel that is thermally expandable.

It is a still further object of the present invention to provide a roofing panel that utilizes concealed anchoring members.

The slim seam roofing panel according to the present invention comprises a generally planar roofing panel section, a first, upstanding male section integrally connected to the panel section, and a second, upstanding female section integrally connected to the panel section at a location remote from and parallel with the male section for mounting over the male section of an identical adjoining roofing panel so as to form a slim seam. The male section includes a vertical portion that is received within the female section, a lower arcuate mounting portion and parallel upper and lower horizontal extension portions. The female section includes two parallel vertical spaced-apart portions that receive the male section vertical portion, and a horizontal extension portion that is received within the male section horizontal extension portions. The roofing panel also comprises an anchoring member that captures the male section arcuate mounting portion. The anchoring member and arcuate mounting portion cooperatively minimize wind uplift while permitting roofing panel to thermally expand. Moreover, the anchoring member, capturing only the arcuate mounting portion, is hidden from view. Further, since the slim seam is assembled by mounting the female section over the male section of the adjoining roofing panel, no mechanical tools are needed.

Other objects, features and advantages of the present invention will appear from the following detailed description of the best mode of a preferred embodiment, taken together with the accompanying drawings.

BEST MODE FOR CARRYING OUT THE INVENTION

Figure 1:
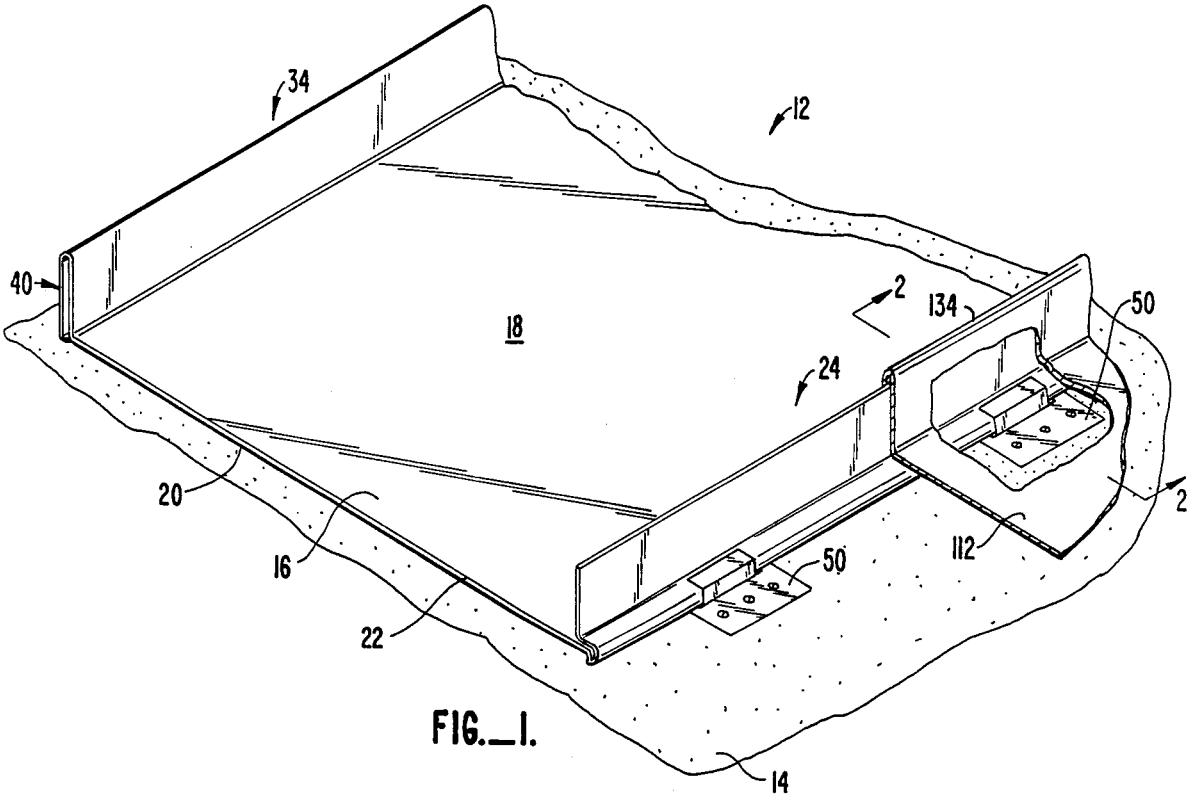
FIG. 1 is a perspective view of a slim seam roofing panel of the present invention, as mounted onto a roof structure, with portions broken away.

Referring to the figures, there is shown a slim seam roofing panel of the present invention, designated 12. Roofing panel 12 is mounted to a roof structure 14. More particularly, roofing panel 12 comprises a generally planar roofing panel section 16 that has a top surface 18, a bottom surface 20, and opposed side edges 20. Only one of side edges 20 is illustrated in FIG. 1. The distance between bottom surface 20 of panel section 16 and roof structure 14 is generally defined herein as a gap "G". In addition, panel section 16 has a particular thickness "T". If roofing panel 12 is manufactured from 24-guage steel, the thickness T of panel section 16 would be approximately 0.0276 inch. If roofing panel 12 is manufactured from aluminum, the thickness T would be approximately 0.032 inch.

Figure 2:
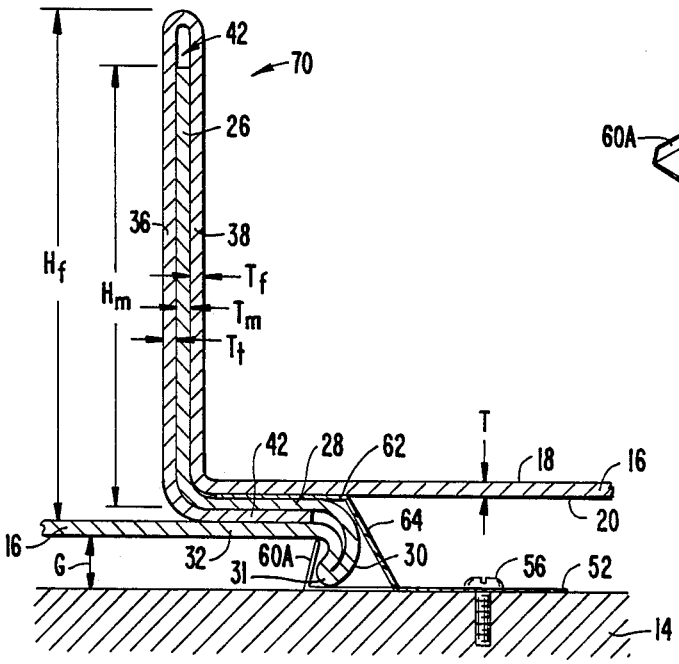
FIG. 2 is an enlarged, cross section view of the slim seam roofing panel of FIG. 1 taken along line 2-2, with portions broken away.

Roofing panel 12 also comprises a first, upstanding male section 24 that is integrally connected to panel section 16. As best shown in FIG. 2, male section 24 includes a vertical, upstanding portion 26; an upper, horizontal extension portion 28 that is integrally connected to vertical upstanding portion 26; an arcuate mounting portion 30 that is integrally connected to upper horizontal extension portion 28; and a lower, horizontal extension portion 32 that is integrally connected to both arcuate mounting portion 30 and panel section 16. Upper horizontal extension portion 28 is in parallel with lower horizontal extension portion 32. The apical portion of arcuate mounting portion is generally referred to as a toe 31. Male section 24 has a particular height "$H_m$" that is approximately 1.10 inches in the preferred embodiment. In addition, male seotion 24 has a partioular thiokness "$T_m$" that is approximately equal to the thickness T of panel section 16.

Roofing panel 12 further comprises a second, upstanding female section 34 that is integrally connected to panel section 16 at a location remote from and parallel with male section 24. As readily recognized by those skilled in the art, male section 24 and female section 34 are in essence the opposite ends of panel section 16, as best shown in FIG. 1. To assemble a roof, the female section of one roofing panel must be locked over the male section of an adjoining roofing panel, e.g., female section 134 of roofing panel 112 must lock over male section 24 of panel 12. Roofing panel 112 in FIG. 1 is illustrated with its front side edge broken away, i.e., its side edge that should be in juxtaposition with side edge 22 of roofing panel 12 is missing so as to expose male section 24 for illustrative purposes. To prevent confusion in the instant description, like elements are identified by the same numeral, e.g., both of the planar roofing panel sections in FIG. 2 are identified as "16" when in actuality one should be identified as "116." Similarly, the female section in FIG. 2 is identified as "34" instead of "134".

In particular, female section 34 has two parallel, vertical, upstanding spaced-apart portions 36 and 38. Vertical upstanding portion 38 is integrally connected to panel section 16. In addition, parallel upstanding portions 36 and 38 define a central opening 40 that is capable of receiving male section vertical portion 26, as best shown in FIG. 1. Female section 34 further comprises a horizontal extension portion 42 that is integrally connected to vertical portion 36. Horizontal extension portion 42 is received between male section upper and lower horizontal extension portions 28 and 32. Female section 34 has a height "$H_f$" that is greater than the height $H_m$ of male section 24. In the preferred embodiment, female section height $H_f$ is approximately 1.375 inches. In addition, female section 34 has a particular thickness "$T_f$", i.e., the thickness of each of vertical portions 36 and 38, that is approximately equal to the thickness T of panel section 16.

In the preferred embodiment, the distance between male section 24 and female section 34 is approximately 12 inches. The distance between side edges 20 is approximately 30 feet. Depending on the specific application, the seam-to-seam distance could be 16 inches and the side edge-to-side edge distance could be in the range of 10 feet to 60 feet. Moreover, no additional seaming devices or tools are used to assemble two adjoining roofing panels 12.

Figure 3:
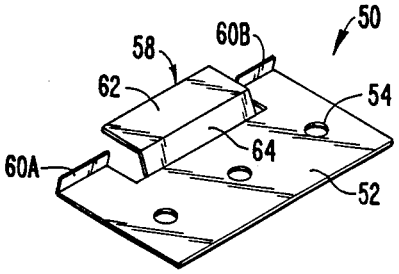
FIG. 3 is an enlarged, perspective view of an anchoring member for anchoring the roofing panel of FIG. 1.

Roofing panel 12 further comprises an anchoring member or clip 50 that secures roofing panel 12 to roof structure 14. As best shown in FIGS. 2 and 3, anchoring member 50 comprises a horizontal base portion 52 that includes a plurality of mounting apertures 54. Each of the mounting apertures 54 receives a conventional fastener 56. Anchoring member 50 also comprises an upper mounting flange 58 and a pair of lower mounting flanges 60A and 60B. Upper mounting flange 58 includes a first horizontal portion 62 and a sloped portion 64 that is not orthogonal to base portion 52. Upper mounting flange horizontal portion 62 is received between panel section 16 and male section upper horizontal extension portion 28. Lower mounting flanges 60A and 60B envelop male section arcuate mounting portion 30. Once assembled, mounting number 50 is concealed by panel section 16, as best shown in FIG. 1

The particular configuration of anchoring member 50 has several attributes. First, it is attached only to the lower portions of roofing panel 12, e.g. arcuate mounting portion 30. This is in contrast to prior art anchoring members which generally mount over, or hook over, what is analogous to male section vertical portion 26. Using such a technique, prior art standing seams would naturally include, as part of their total dimension, the thickness of a portion of the anchoring member. The increased thickness in the standing seam detracts from the desired slim profile. In addition, the increased thickness enhances the likelihood of moisture seeping into the standing seam, contributing to the corrosion of the standing seam.

Next, the particular configuration of anchoring member 50, in conjunction with arcuate mounting portion 30, contribute to the wind resistant capability of roofing panel 12. Wind, travelling across the top surface of a conventional planar roofing panel section that is analogous to panel section 16, could bow up or uplift the middle portion of that panel section. Whereas the distance between the lower surface of the conventional panel section and a roof structure, analogous to gap "G" of the present invention, is normally approximately $\frac{1}{8}$ inch, the aerodynamical effect of the wind may increase that gap to approximately 3 inches. Anchoring member 50, in conjunction with arcuate mounting portion 30, minimize such wind uplift. During wind uplift in the present invention, the upward movement of panel section 16 causes arcuate mounting portion 30 to rotate and further engage sloped flanges 60A and 60B and slope portion 64. In particular, the tip or toe 31 of arcuate mounting portion 30 would bite into flanges 60A and 60B. Thus, this type of counter-reaction inhibits further uplift of panel section 16.

Moreover, the particular configuration of anchoring member 50 also does not inhibit the thermal expansion or contraction of roofing panel 12. In the preferred embodiment, a roofing panel 12 that is 32 feet in length may thermally expand approximately 0.75 inch. In such an expansion, panel section 16 tends to buckle. Whereas prior art anchoring members, which are mounted over the entire male section, do not permit the seams to expand, anchoring member 50 does permit male section 24 to expand. This is due to the fact that anchoring member 50 is only restricting the movement of the lower portions of male section 24 and female section 34. With only upper mounting flange horizontal portion 62 positioned between planar roofing panel section 16 and male section horizontal portion 28, the thermal expansion of the remaining portions of the seam are not restricted. Since upper mounting flange horizontal portion 62 is also capable of thermal expansion, it would conform to the amount of expansion of adjoining seam portions.

In assembling a roof, a first roofing panel 12 is mounted onto roof structure 14. Anchoring members 50 are used to secure male section 24 to roof structure 14. Female section 34 of an adjoining roofing panel is then fitted over male section 24, with horizontal extension portion 42 locked between upper and lower horizontal extension portions 28 and 32 of male section 24. In addition, vertical upstanding portion 26 of male section 24 is fitted within central opening 40 of female section 34. In the preferred embodiment, an upper recess of central opening 40, designated 42, generally receives a conventional sealant/adhesive. Recess 42 has a length of approximately ¼ inch. Thus assembled, vertical upstanding portions 26, 36 and 38 define a slim standing seam 70. Since each of vertical upstanding portions 26, 36 and 38 has a thickness that is approximately equal to thickness T, the total thickness "$T_t$" of slim seam 70 is approximately three times the thickness of thickness T.

It will be apparent to those skilled in the art that various modifications may be made within the spirit of the invention and the scope of the appended claims.

We claim:

1. A slim seam roofing panel system having a plurality of roofing panel sections positioned adjacent one another, each of the roofing panel sections comprising a generally planar roofing panel section having top and bottom surfaces, and opposed side edges;

a first, upstanding male section integrally connected to the planar roofing panel section, wherein the male section has a particular height and a lower, arcuate mounting portion that is integrally connected to the planar roofing panel section; and a second, upstanding, freestanding female section integrally connected to the planar roofing panel section at a location remote from and parallel with the male section for mounting over the male section of an identical adjoining roofing panel, wherein the female section has two substantially parallel plates connected together each of the plates having a height that is greater than the height of the male section, and a central opening formed between the two plates that snugly receives the male section of the adjacent roofing panel, whereby the female section and the male section of the adjoining roofing panel form an assembled slim seam.

2. The slim seam roofing panel as claimed in claim 1, wherein the planar roofing panel section is subjected to a vertical movement caused by aerodynamical forces, further comprises an anchoring member for capturing the male section arcuate mounting portion, whereby the anchoring member and the arcuate mounting portion cooperatively minimize the vertical movement.

3. The slim seam roofing panel as claimed in claim 2, wherein the slim seam is capable of thermal expansion, and furtherwherein the anchoring member, solely constricting the arcuate mounting portion, permits the thermal expansion of the slim seam.

4. The slim seam roofing panel as claimed in claim 2 or 3, wherein the anchoring member comprises an upper horizontal mounting flange that is received between the planar roofing panel section and the male section, and a pair of non-orthogonal mounting flanges which envelop the arcuate mounting portion of the male section.

5. The slim seam roofing panel as claimed in claim 1, wherein the male section further comprises a vertical, upstanding portion that is received within the female section, an upper, horizontal extension portion that is integrally connected to the vertical upstanding portion, and a lower, horizontal extension portion that is integrally connected to both the arcuate mounting portion and the planar roofing panel section, wherein the lower horizontal extension portion is in parallel with the upper horizontal extension portion.

6. The slim seam roofing panel as claimed in claim 5, wherein the female section further comprises two parallel, vertical, upstanding, spaced-apart portions one of which being integrally connected to the planar roofing panel section so as to define the central opening, and a horizontal extension portion that is integrally connected to one of the spaced-apart upstanding portions, wherein the horizontal extension portion is received within the upper and lower horizontal extension portions of the male section.

7. A slim seam roofing panel system having a plurality of roofing panel sections positioned adjacent one another, each of the roofing panel sections comprising a generally planar roofing panel section having top and bottom surfaces, and opposed side edges, wherein the planar roofing panel section has a particular thickness;

a first, upstanding male section integrally connected to the planar roofing panel section, wherein the male section has a particular height, a thickness that is approximately equal to the thickness of the planar roofing panel section and a lower, arcuate mounting portion that is integrally connected to the planar roofing panel section; and a second, upstanding, freestanding female section integrally connected to the planar roofing panel section at a location remote from and parallel with the male section for mounting over the male section of an identical adjoining roofing panel, wherein the female section has two substantially parallel plates connected together each of the plates having a height that is greater than the height of the male section, a central opening formed between the two plates that snugly receives the male section of the adjacent roofing panel, and a thickness that is approximately equal to the thickness of the planar roofing panel section, whereby the female section and the male section of the adjoining roofing panel form an associated slim seam having a thickness that is approximately three times the thickness of the planar roofing panel section.

8. The slim seam roofing panel as claimed in claim 7, wherein the male section further comprises a vertical, upstanding portion that is received within the female section, an upper, horizontal extension portion that is integrally connected to the vertical upstanding portion, and a lower, horizontal extension portion that is integrally connected to both the arcuate mounting portion and the planar roofing panel section, wherein the lower horizontal extension portion is in parallel with the upper horizontal extension portion, and furtherwherein the arcuate mounting portion is integrally connected to the upper horizontal extension portion.

9. The slim seam roofing panel as claimed in claim 8, wherein the female section further comprises two parallel, vertical, upstanding, spaced-apart portions one of which being integrally connected to the planar roofing panel section so as to define the central opening, and a horizontal extension portion that is integrally connected to one of the spaced-apart upstanding portions, wherein the horizontal extension portion is received within the upper and lower horizontal extension portions of the male section.

10. The slim seam roofing panel as claimed in claim 8, wherein the planar roofing panel section is subjected to a vertical movement caused by aerodynamical forces, further comprises an anchoring member for capturing the male section arcuate mounting portion, whereby the anchoring member and the arcuate mounting portion cooperatively minimize the vertical movement.

11. The slim seam roofing panel as claimed in claim 10, wherein the slim seam is capable of thermal expansion, and furtherwherein the anchoring member, solely constricting the arcuate mounting portion, permits the thermal expansion of the slim seam.

12. The slim seam roofing panel as claimed in claim 10 or 11, wherein the anchoring member comprises an upper horizontal mounting flange that is received between the planar roofing panel section and the upper horizontal extension portion of the male section, and a pair of non-orthogonal mounting flanges which envelop the arcuate mounting portion of the male section.

13. A slim seam roofing panel system having a plurality of roofing panel sections positioned adjacent one another, each of the roofing panel sections comprising a generally planar roofing panel section having top and bottom surfaces, and opposed side edges, wherein the planar roofing panel section has a particular thickness;

a first, upstanding male section integrally connected to the planar roofing panel section, wherein the male section has a particular height and a thickness that is approximately equal to the thickness of the planar roofing panel section, and furtherwherein the male section comprises a vertical, upstanding portion, an upper, horizontal extension portion that is integrally connected to the vertical upstanding portion, an arcuate mounting portion that is integrally connected to the upper horizontal extension portion, and a lower, horizontal extension portion that is integrally connected to both the arcuate mounting portion and the planar roofing panel section; and a second, upstanding, freestanding female section integrally connected to the planar roofing panel section at a location remote from and parallel with the male section for mounting over the male section of an identical adjoining roofing panel, wherein the female section has two substantially parallel plates connected together each of the plates having a height that is greater than the height of the male section, a central opening formed between the two plates that snugly receives the male section of the adjoining roofing panel, and a thickness that is approximately equal to the thickness of the planar roofing panel section, and furtherwherein the female section comprises two parallel, vertical, upstanding, spaced-apart portions one of which being integrally connected to the planar roofing panel section so as to define the central opening, and a horizontal extension that is integrally connected to one of the spaced-apart upstanding portions, wherein the horizontal extension portion is received within the upper and lower horizontal extension portions of the male section, whereby the female section and the male section of the adjoining roofing panel form an assembled slim seam having a thickness that is approximately three times the thickness of the planar roofing panel section.

14. The slim seam roofing panel as claimed in claim 13, wherein the planar roofing panel section is subjected to both a vertical movement caused by aerodynamical forces and thermal expansion, further comprises an anchoring member including an upper horizontal mounting flange that is received between the planar roofing panel section and the upper horizontal extension portion of the male section, and a pair of non-orthogonal mounting flanges which envelop the arcuate mounting portion of the male section, whereby the anchoring member and the arcuate mounting portion cooperatively minimize the vertical movement, and furtherwhereby the anchoring member, solely constricting the arcuate mounting portion, permits the thermal expansion of the slim seam.

* * * * *